US006269907B1

(12) United States Patent
Gillespie

(10) Patent No.: US 6,269,907 B1
(45) Date of Patent: Aug. 7, 2001

(54) LADDER ARMS

(76) Inventor: Garnet L. Gillespie, 1606 Hannon Bay E. Regina, Saskatchewan (CA), S4V 0S8

( * ) Notice: Subject to any disclaimer, the term of this patent is extended or adjusted under 35 U.S.C. 154(b) by 221 days.

(21) Appl. No.: 08/815,151

(22) Filed: Mar. 11, 1997

(51) Int. Cl.[7] ..... E06C 5/32
(52) U.S. Cl. ..... 182/129; 248/210
(58) Field of Search ..... 182/129; 248/210, 248/211, 238

(56) References Cited

U.S. PATENT DOCUMENTS

| | | | | |
|---|---|---|---|---|
| 1,972,064 | * | 8/1934 | Mouslon | 248/210 |
| 3,160,383 | * | 12/1964 | Camm | 248/211 |
| 3,223,369 | * | 12/1965 | Benninger | 248/210 |
| 3,784,139 | * | 1/1974 | Ellis | 248/210 |
| 3,822,846 | * | 7/1974 | Jesionowiski | 248/210 |
| 3,980,264 | * | 9/1976 | Tomasik | 248/210 |
| 4,099,693 | * | 7/1978 | Blann | 248/210 |
| 4,702,446 | * | 10/1987 | Brown | 182/129 |
| 4,884,931 | * | 12/1989 | Revol | 248/231.91 |
| 5,279,389 | * | 1/1994 | Crockett | 182/214 |
| 5,316,251 | * | 5/1994 | McGraw | 248/210 |
| 5,636,886 | * | 6/1997 | Jensen | 248/211 |

FOREIGN PATENT DOCUMENTS

| | | | | |
|---|---|---|---|---|
| 2211236 | * | 6/1989 | (GB) | 248/210 |

* cited by examiner

*Primary Examiner*—Alvin Chin-Shue

(57) ABSTRACT

A ladder arm(s) for use in combination with a ladder having an open ended tubular rung with an irregular inner surface to support a container. The ladder arm has an elongate body member to be slideably received in the rung and having a first end and a second end with a frictional device at the first end and a torque applying and retaining handle at the second end. Torque applied to the handle causes the frictional device to lock against the inner surface of the rung thus providing a holding support for a container with handle. There can be provided a bracket between the ladder arm and the container especially where smaller containers with no handle are used. There also can be provided two hangers one on a ladder arm supported in each open end of the rung. There is supported by the two hangers a tray type container fixed to the hangers.

10 Claims, 4 Drawing Sheets

Fig. 4
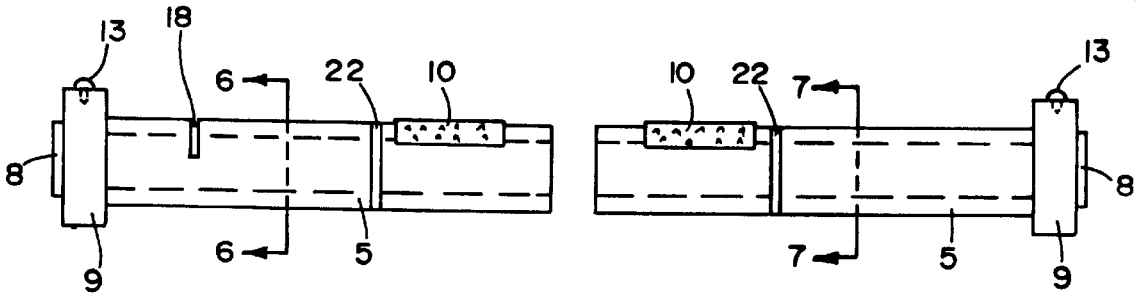
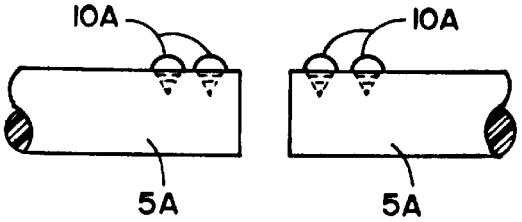
Fig. 5
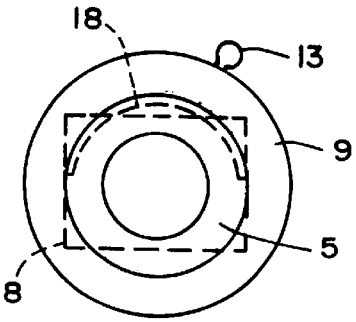
Fig. 6
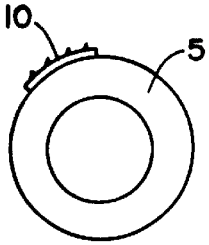
Fig. 7

LADDER ARMS

This application relates to material supports and more particularly to supports or arms slideably and lockably mounted in a tubular ladder rung.

BACKGROUND OF INVENTION

Almost every household has an extension ladder with hollow tubular rungs or steps fixed between two parallel elongate members or rails. When using this ladder it is frequently required that the user have some equipment or the like that he or she will be using to do nailing, painting, cleaning or the like. As a matter of convenience some form of arm or arms is required that will support a tray or container. Applicant has provided arms that are slideably and lockably mounted within the hollow rung so that one or both of the arms can be made operational or they may be easily relocated to another hollow rung. One arm can be used by itself but used in pairs is most common. Both arms are fully retracted and locked when in position for transport or storage.

The best prior art known to applicant are U.S. Pat. No. 4,099,693 to Blann in 1978, U.S. Pat. No. 4,186,903 to Fazakerley in 1980, U.S. Pat. No. 4,445,659 to LaChance in 1984 and U.S. Pat. No. 5,293,957 to Lunden Jr. in 1994.

The patent to Blann, "693", teaches a container support that passes completely through the ladder rung for retention. No provision is made for supporting a container on both sides of the ladder at the same time at the same elevation nor is there any provision for storage of the support on the ladder after use. Applicants device in contrast is extremely simple in that one main feature of the invention is an elongate body carrying a friction means to engage the inside of the rung and a torque applying means to cause engagement of the friction means and retain the container. If a container on each side of the ladder is required two such extendable arms are used.

The patent to Fazakerley, "903", teaches an insertable section expandable to frictionally hold the device inserted inside the ladder rung. To the inserted section is pivotally attached a container support and a paint brush support as a unit. As mentioned above applicants device has an elongate body member with friction means mounted thereon which when rotated engages the inside of the rung. The arms of the instant invention will work only for the common "D" type rung or the like since the friction means must be inserted and rotated to engage the circular portion of the rung. A single arm rotated and locked easily holds a large paint container having a handle in a most advantageous position for full access to the paint. A single arm locked in position holding a bracket easily supports a smaller paint can in an easily accessible position at the same elevation if desired.

The patent to LaChance, "659", teaches an adjustable ladder tray that requires pipes slideably received in ladder rungs, a tray clamped thereto and a slideable adjustment linking the tray to the pipes. Applicants device is different in that no two arms are found in two separate rungs, joined and supporting a tray.

The patent to Lunden Jr. "957" teaches a rigid circular first portion to support a tapered container at its top and a second elongate rigid U-shaped portion upturned at a free end and covered by a plastic hard surfaced sleeve and joined to the circular first portion. The second portion is inserted into a tubular ladder rung and retained thereby to support the first portion and container. As previously pointed out applicants simple device can hold a large or small paint container in a most advantageous position on either or both sides of the ladder. Rotational locking of an inserted elongate member is all that is required.

SUMMARY OF THE INVENTION

It is desirable to carry out any task as expeditiously and as effortless as possible. To this end there is herein provided for use with a ladder having an irregularly shaped inner surface of a hollow rung, an arm or preferably a pair of arms, to support material required to carry out the task. Basically each arm comprises an elongate substantiably cylindrical means having a retaining and manipulating means at one end and a frictional means near the opposite end. As previously mentioned a pair of arms each one inserted in opposite ends of the hollow rung is often utilized to enable a multi-functional system as desired. As a pair the arms can also be connected in the stored position or various extended positions by a safety strip which engages a knob pin on each of the manipulating and retaining knob means. It is the irregular shape of the inner surface of the hollow rung that permits passage of the safety strip from one end to the other and slideable adjustment of the arm means with its raised frictional means which when rotated jams or locks against the major circular inner portion of the hollow rung. A single arm means can hold a large open container in a most accessible position. A single arm means can hold a smaller supported open container in a most accessible position at the same or different elevations singley or at the same time as the large container. The two arms extended at the same elevation can support an elongate tray with hangers each engaging one arm.

From the above summary it is readily discernible that the principal object of the present invention is to provide an extendable arm slideable and lockable in a hollow irregular shaped inner surface rung of a ladder to support material.

It is a further object of the present invention to provide two similar arms slideable and lockable in a hollow rung of a ladder that can be adjustably held in various positions by a safety strip engaging knob pins on the retaining and manipulating knob means.

It is still a further object of the present invention to provide a material supporting means that is simple in structure, easy and cheap to manufacture, yet effective.

These and other objects of the present invention will become readily apparent as the following description is read in conjunction with the accompanying drawings wherein like reference numerals indicate like elements throughout the several views.

DESCRIPTION OF THE DRAWINGS

FIG. 3 is a perspective view of two arms each simultaneously supporting a can of paint or the like.

FIG. 4 is a front elevation of a pair of arms as they would appear when positioned inside a hollow rung.

FIG. 5 is a partial front elevation of an end portion of a pair of arms showing a different frictional means and an alternate structual body member material.

FIG. 6 is a cross section of a first of the arms taken at the cutting plane 6—6.

FIG. 7 is a cross section of a second of the arms taken at the plane 7—7.

DETAILED DESCRIPTION OF THE INVENTION

Figure 1:
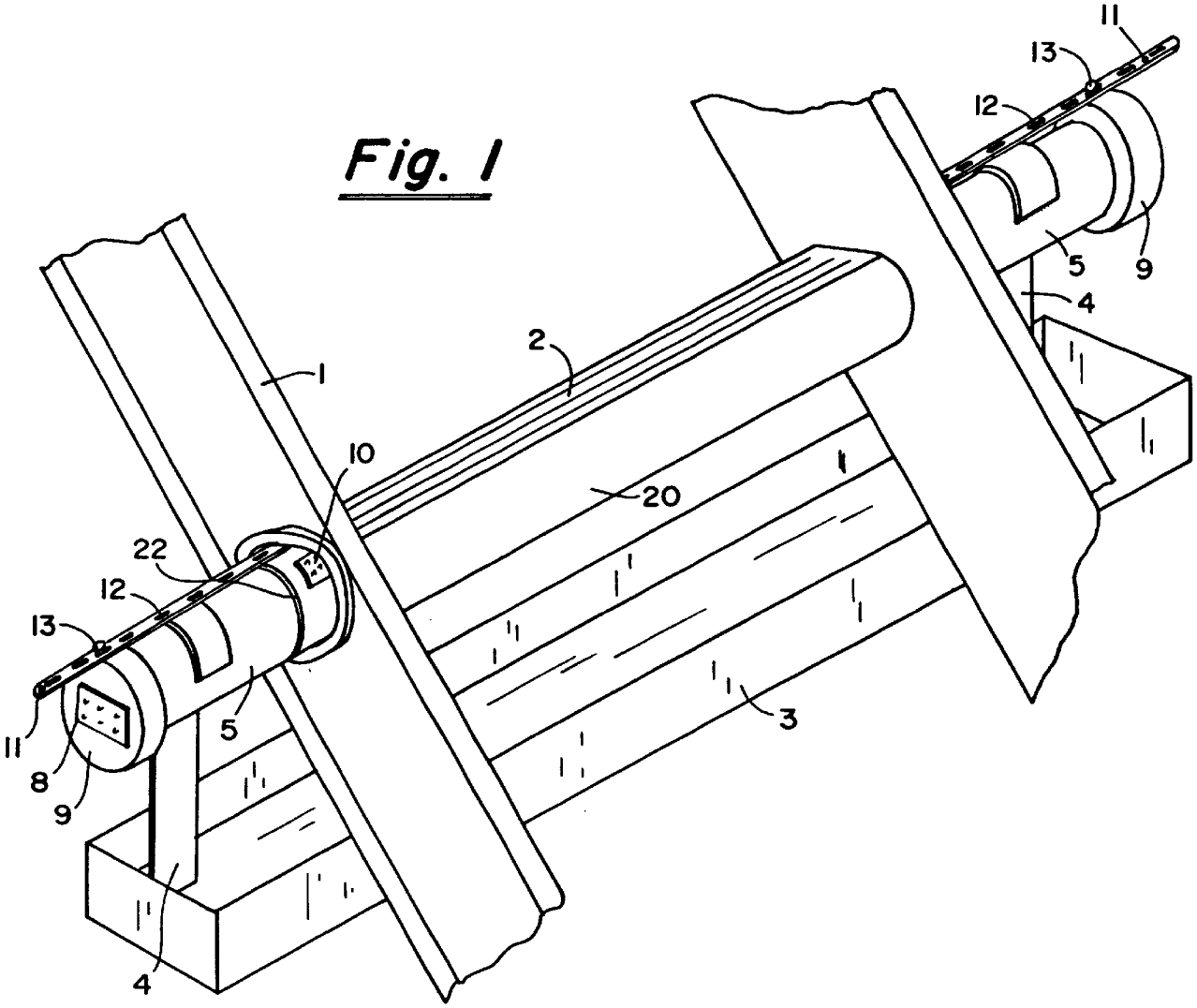
FIG. 1 is a perspective view of a portion of a ladder having a hollow rung with two arms extending therefrom and supporting a tray for miscellaneous materials.

There is shown in FIG. 1 a partial perspective of a ladder, ladder arms and tray assembly. The ladder 1 illustrated is the well known aluminum ladder with well known hollow rungs 20 having a flat tread 2. Because of the flat tread 2 the interior periphery of the rung 20 is flat at the top with a circular lower portion. Two ladder arms each including head means 9, body means 5 and locking means 10 are shown inserted inside the ladder rung 20. Because of the irregular internal shape of the rung 20 there is a space at two sides of the opening so that the friction locking means 10 can enter at one side and the connecting safety means 11 can enter at the other side. The locking means 10 can take various forms such as a piece of rubber glued to the outer surface of a body means 5 or it may be a raised portion of the body means 5 with a frictional material sprayed thereon or screws 10A penetrating the body means as shown in FIG. 5. When the body means 5 are extended out from the ladder rung the locking means 10 should just be visible so that there is still a sufficient length remaining inside the rung 20 for a strong support. A painted line 22 for a safety limit may also be used. In the normal full operating position about 4" of each body means 5 is visible with about 3" inside the rung 20. For locking, the retaining and manipulating knob or head means 9 is grasped and rotated so that the locking means 10 moves toward the circular portion of the interior of the rung 20 causing a wedging action. When one or both of the body means 5 are extended and locked the flexible safety strip means 11, usually made of plastic, is passed through the interior of the rung and at each end one of the apertures 12 is forced over retainer knob pins 13 to prevent accidental loss of the ladder arms during operation or transport. The flexible safety strip means 11 may be of any flexible material but must be sufficiently rigid to easily pass through the interior of the rung 20. A piece of fine wire fixed around knob pins 13 has also proven satisfactory. Changing of the ladder arms to a different rung is easily achieved by unlocking the safety strip means 11 unlocking the locking means 10 and sliding the arms out of the inside of the rung and reversing the steps for installation. The safety means 11 can in fact be made of frictional material in which case it could replace the locking means 10. The arms are most frequently used without the safety strip means 11 since there is an unbelievable locking action especially when the locking means 10 is of a harder material than rung 20 which is most commonly made of aluminum. The use of ladder arms is here shown for the purpose of supporting a tray 3 which is unlimited as to what material or equipment it may contain. The tray 3 is supported by tray hangers 4 hooked over the body means 5. The ladder arms may also carry a piece of "VELCRO" 8 on knob or head means 9 for convenient retention of any article carrying a cooperating piece of "VELCRO".

Figure 2:
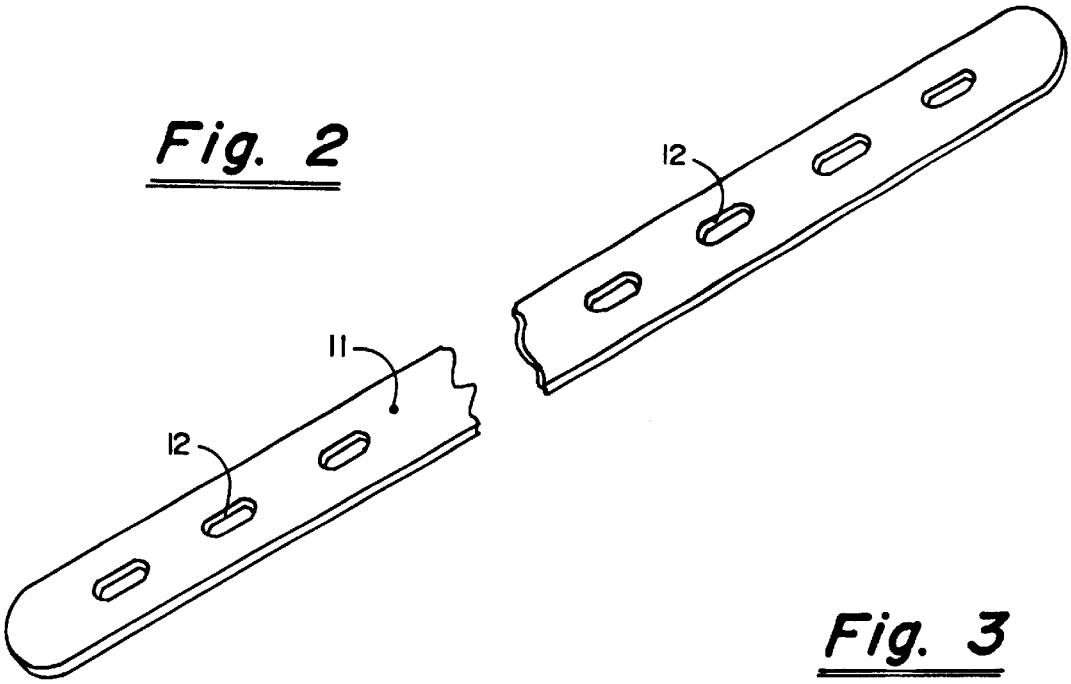
FIG. 2 is a perspective view of a safety strip with a multiplicity of adjustment eyes.

The perspective view in FIG. 2 is shown to clearly indicate a flexible plastic connecting safety strip means 11 with adjustment apertures 12. While plastic is preferred a safety strip of frictional material could be used providing an assisting or alternate locking action as previously mentioned. As also previously mentioned a strip of fine wire can suffice as a safety retaining strip.

Figure 3:
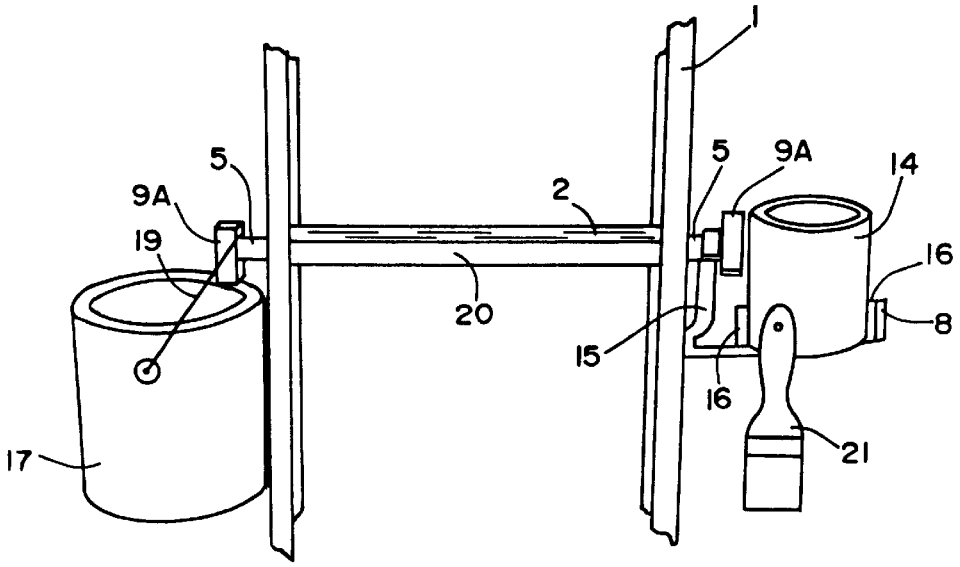

The application of the invention shown in FIG. 3 has a direct relationship to the situation exhibited in the known prior art. What is taught here is two separate and independent ladder arms each comprising a modified retaining and torque applying head or knob means 9A shaped for ease of torque application mounted on a tubular ladder arm body 5 which carries a modified locking means 10A (shown in FIG. 5). Each ladder arm can be used totally independent as they are slideably mounted and locked in a hollow tubular rung 20 of a ladder 1. On the left hand side is shown a 4 liter paint container 17 retained in a totally accessible manner by the handle 19 hooked over the knob means 9A and laterally supported against the ladder 1. Tools etc. can be placed in and supported by any other such container if desired. On the right hand side is shown the identical ladder arm, 9A, 5 and 10A slideably inserted and locked in a desired position by torquing but carrying a container support bracket 15 hooked over ladder arm body 5 and being laterally supported by ladder 1. Container supported bracket 15 includes laterally adjustable uprights 16 to laterally restrict movement of a smaller 1 liter paint container 14 or any other smaller container. Attached to any of the uprights 16 in any convenient manner is a piece of "VELCRO" 8 which cooperates with a corresponding piece of "VELCRO" mounted on the underside of paint brush 21. The two pieces of "VELCRO" holding the brush 21 are hidden by the brush handle.

Referring now to FIG. 4 there are two ladder arms comprised basically of a head or knob means 9, a body means 5 and a frictional means 10 as they would appear located in a ladder rung 20. Each arm has added thereto a piece of "VELCRO" 8 on the free end of knob means 9, a knob pin 13 on knob means 9 and a safety limit line 22 painted or otherwise indicated on ladder arm body 5. The ladder arm on the left further contains a groove 18 for the fixed location of a wire container handle or the like if desired. Cutting planes 6 and 7 are clearly illustrated in FIGS. 6 and 7.

Looking now at FIG. 5 it is there illustrated the ends of the ladder arm bodies 5A as being of solid plastic, and the locking means 10A as being threadedly fixed to bodies 5A. While a specific alternative has been shown here it is to be realized that the ladder arm body 5 may be of tubular plastic with locking means 10A threaded therein. The use of wood and metal for any or all of the basic elements 9 and 5 or 9A and 5A are envisaged.

FIG. 6 clearly shows the cutting plane 6 of FIG. 5. There can be seen the retaining and torque applying head or knob 9 with a knob pin 13 attached thereto and the tubular ladder arm body 5 formed with or attached to the head or knob 9. The groove 18 is formed or cut in the arm body 5 for locating a handle of a container in a desired position and "VELCRO" 8 has been added to head or knob 9 to support any of a number of items as desired.

FIG. 7 clearly shows the cutting plane 7 of FIG. 4. There is here shown the tubular ladder arm body 5 with friction locking means 10 firmly attached thereto or formed therewith.

Figure 8:
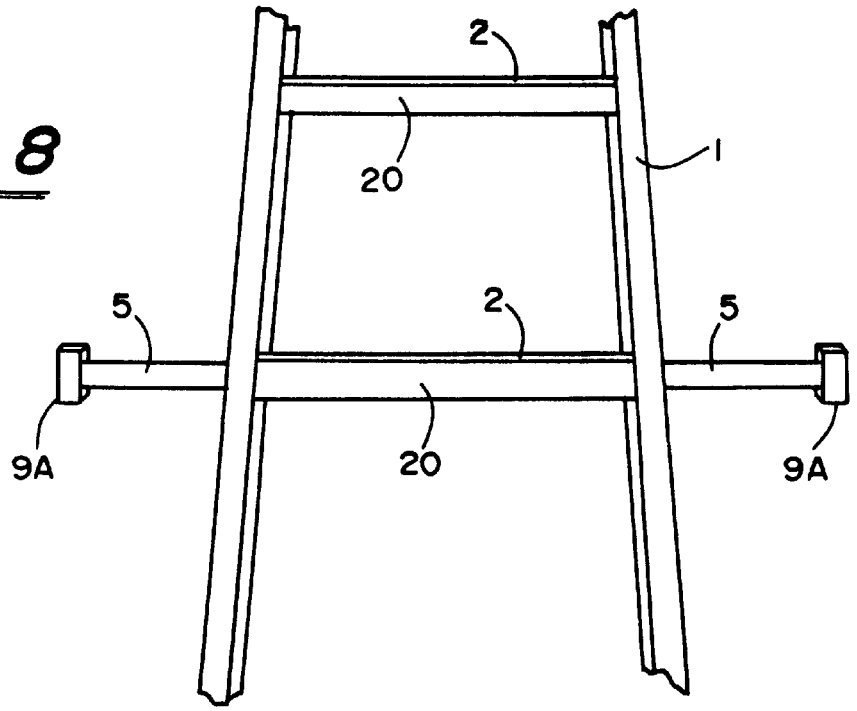
FIG. 8 is a perspective view of a pair of arms each in their extended position.

FIG. 8 is a view in perspective of a ladder 1 with two ladder arms including a head 9A, a body 5 and locking means 10A (not shown) in a fully extended position as it is slideably mounted in the tubular ladder rung 20 of ladder 1. It is of course to be realized that the ladder arms may be mounted in different ladder rungs 20 or that any number of ladder arms may be mounted in several ladder rungs 20.

Figure 9:
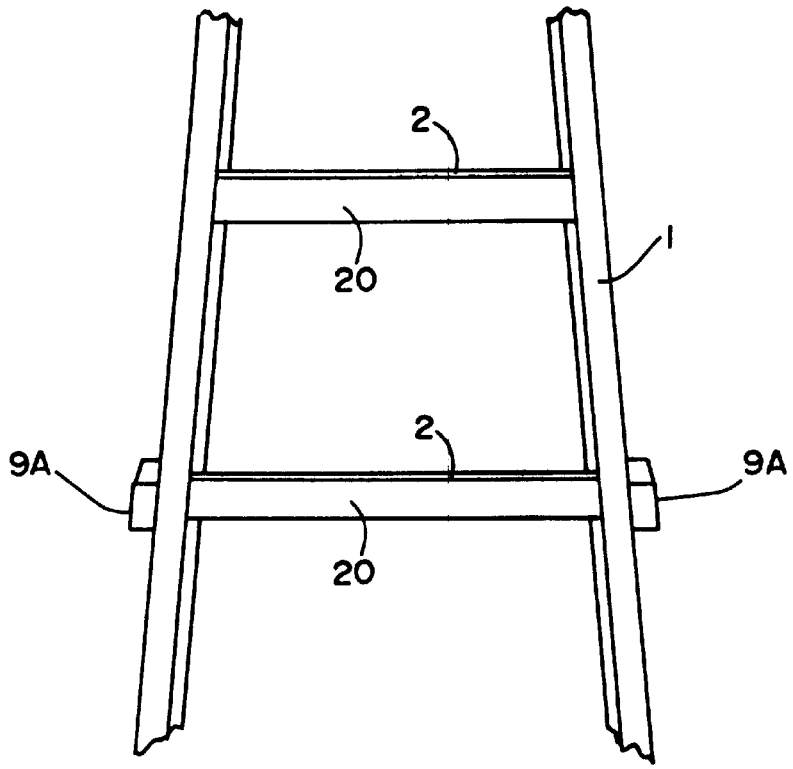
FIG. 9 is a perspective view of a pair of arms each in the fully retracted or storage position.

FIG. 9 is a view in perspective of two ladder arms completely encased in ladder rung 20 with only the head or knob 9A visible. The arms have been rotated to the locked position for the express purpose of storage or transportation.

While not considered to be part of this invention a standard paint tray can be mounted to rung 20 shown in FIG. 3 by a simple "C"-shaped clamp normally made of a resilient metal. Tests with plastic and metallic trays have proven to be quite satisfactory.

Various modifications such as size, shape and arrangement of components may be made without departing from the spirit and scope of this invention. The above disclosure shall be interpreted as illustrative only and limited only by the scope of the invention as defined in the following claims.

What I claim is:

1. The combination with an aluminum type ladder having side rails carrying hollow rungs with open ends and an irregular inner surface, of at least one of, one or more ladder arms for supporting a handled container including an elongate substantially cylindrical body member slideably received and locked in one or more of said open ends of said hollow rungs, locking means carried near a first end of each of said elongate substantially cylindrical body members and a torque applying and retaining knob shaped for ease of torque application located adjacent a second end of each of said elongate substantially cylindrical body members, said locking means being rigid in structure and integrally joined to each of said elongate substantially cylindrical body members whereby upon rotational torque being applied to said torque applying and retaining knob said locking means is rotated about an elongate axis of said elongate substantially cylindrical body member thereby forcing said locking means into locking engagement with said irregular inner surface in such a manner as to easily and securely hold said handled container against said side rail for stabilized support.

2. The combination as claimed in claim 1 wherein said locking means is of a material harder than said inner surface of said hollow rungs.

3. The combination as claimed in claim 1 wherein said torque applying and retaining knob includes a plurality of substantially flat outer grasping surfaces.

4. The combination as claimed in claim 1 wherein said locking means are integrally joined to said elongate substantially cylindrical body means by screw thread means.

5. The combination as claimed in claim 1 wherein said ladder arms are formed as a single unitary structure.

6. The combination as claimed in claim 5 wherein said single unitary structure is plastic.

7. The combination as claimed in claim 1 further including a support bracket mounted on a ladder arm in addition to said at least one ladder arm for supporting a handled container.

8. The combination as claimed in claim 1 further including, a retainer knob pin fixed to said torque applying and retaining knob and a safety strip attached thereto to prevent accidental ladder arm loss at any time.

9. A unitary ladder arm type of support for use with a ladder having side rails carrying hollow rungs with open ends and an irregular inner surface, said ladder arm type of support having a torque applying and retaining means, said ladder arm support having an elongate substantially cylindrical body member, and said ladder arm type of support having a locking means, said elongate substantially cylindrical body member includes a first end and a second end and further includes a central longitudinal axis for rotation thereabout, said torque applying and retaining means integral with and located at said second end including outer peripheral projections for effective hand manipulation when rotating said unitary ladder arm type of support about said central longitudinal axis and having a retaining innermost end surface inwardly of said second end for engaging objects such as a container handle, said locking means being integral with said elongate substantially cylindrical body member near said first end thus providing a complete integral unit that will when inserted in and locked to one of said rungs support a variety of objects, wherein said locking means are made integral with said elongate substantially cylindrical body member by screw thread means.

10. A unitary ladder arm type of support as claimed in claim 9 wherein said substantially cylindrical body member is tubular.

* * * * *